US008643580B2

(12) United States Patent
Kurokawa et al.

(10) Patent No.: US 8,643,580 B2
(45) Date of Patent: Feb. 4, 2014

(54) METHOD FOR DRIVING LIQUID CRYSTAL DISPLAY DEVICE

(75) Inventors: Yoshiyuki Kurokawa, Sagamihara (JP); Takayuki Ikeda, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 139 days.

(21) Appl. No.: 13/213,511

(22) Filed: Aug. 19, 2011

(65) Prior Publication Data

US 2012/0050348 A1 Mar. 1, 2012

(30) Foreign Application Priority Data

Aug. 31, 2010 (JP) ..... 2010-194546

(51) Int. Cl.
*G09G 3/36* (2006.01)

(52) U.S. Cl.
USPC ..... 345/96; 345/87; 345/209

(58) Field of Classification Search
None
See application file for complete search history.

(56) References Cited

U.S. PATENT DOCUMENTS

| | | | |
|---|---|---|---|
| 5,128,782 | A | 7/1992 | Wood |
| 5,225,823 | A | 7/1993 | Kanaly |
| 5,337,068 | A | 8/1994 | Stewart et al. |
| 5,416,496 | A | 5/1995 | Wood |
| 5,977,942 | A | 11/1999 | Walker et al. |
| 6,243,069 | B1 | 6/2001 | Ogawa et al. |
| 6,590,553 | B1 | 7/2003 | Kimura et al. |
| 6,597,348 | B1 | 7/2003 | Yamazaki et al. |
| 6,882,012 | B2 | 4/2005 | Yamazaki et al. |
| 7,193,593 | B2 | 3/2007 | Koyama et al. |
| 7,224,339 | B2 | 5/2007 | Koyama et al. |
| 7,268,756 | B2 | 9/2007 | Koyama et al. |
| 7,317,438 | B2 | 1/2008 | Yamazaki et al. |

(Continued)

FOREIGN PATENT DOCUMENTS

| | | | |
|---|---|---|---|
| EP | 0496532 | A2 * | 7/1992 |
| JP | 2003-186451 | | 7/2003 |
| JP | 2006-220685 | A | 8/2006 |

OTHER PUBLICATIONS

Baron.P et al., "36.4: Can Motion Compensation Eliminate Color Breakup of Moving Objects in Field-Sequential Color Displays?,", SID Digest '96 : SID International Symposium Digest of Technical Papers, 1996, vol. 27, pp. 843-846.

(Continued)

*Primary Examiner* — Seokyun Moon
(74) *Attorney, Agent, or Firm* — Eric J. Robinson; Robinson Intellectual Property Law Office, P.C.

(57) ABSTRACT

A method for driving a liquid crystal display device includes the steps of supplying a first image signal used to apply a positive voltage to liquid crystal to pixels via a first and second data lines during a first period; deselecting the pixels with scan lines to supply a second image signal used to apply a negative voltage to liquid crystal which is to be supplied to the pixels in the first row to first data lines and supply the second image signal used to apply a negative voltage to the liquid crystal which is to be supplied to the pixels in the (n+1)-th row to second data lines during a second period; and supplying the second image signal used to apply a negative voltage to the liquid crystal to the pixels via the first and second data lines during a third period.

16 Claims, 11 Drawing Sheets

(56) References Cited

U.S. PATENT DOCUMENTS

| | | | | |
|---|---|---|---|---|
| 7,362,304 | B2 | 4/2008 | Takatori et al. | |
| 7,385,579 | B2 | 6/2008 | Satake | |
| 7,403,177 | B2 | 7/2008 | Tanada et al. | |
| 7,425,937 | B2 | 9/2008 | Inukai | |
| 7,564,443 | B2 | 7/2009 | Takatori et al. | |
| 7,773,066 | B2 | 8/2010 | Yamazaki et al. | |
| 7,791,571 | B2 | 9/2010 | Ohtani et al. | |
| 7,834,830 | B2 | 11/2010 | Yamazaki et al. | |
| 7,855,770 | B2 | 12/2010 | Egi et al. | |
| 2002/0075249 | A1 | 6/2002 | Kubota et al. | |
| 2004/0056831 | A1 | 3/2004 | Takatori et al. | |
| 2004/0207578 | A1* | 10/2004 | Koyama | 345/76 |
| 2005/0012097 | A1 | 1/2005 | Yamazaki | |
| 2007/0279374 | A1 | 12/2007 | Kimura et al. | |
| 2008/0055197 | A1* | 3/2008 | Iisaka et al. | 345/55 |
| 2008/0158140 | A1 | 7/2008 | Takatori et al. | |
| 2009/0237349 | A1* | 9/2009 | Numao | 345/102 |
| 2009/0321737 | A1 | 12/2009 | Isa et al. | |
| 2010/0148177 | A1 | 6/2010 | Koyama et al. | |
| 2010/0182282 | A1 | 7/2010 | Kurokawa et al. | |
| 2010/0321420 | A1 | 12/2010 | Ohtani et al. | |
| 2011/0001725 | A1 | 1/2011 | Kurokawa | |
| 2011/0025729 | A1 | 2/2011 | Yamazaki et al. | |
| 2011/0051034 | A1 | 3/2011 | Egi et al. | |

OTHER PUBLICATIONS

Kurita.T et al., "Evaluation and Improvement of Picture Quality for Moving Images on Field-sequential Color Displays,", IDW '00 : Proceedings of the 17th International Display Workshops, 2000, pp. 69-72.

Taira.K et al., "A15 Field-Sequential Display without Color Break-Up using an AFLC Color Shutter,", IDW '00 : Proceedings of the 17th International Display Workshops, 2000, pp. 73-76.

Jarvenpaa.T, "7.2: Measuring Color Breakup of Stationary Images in Field-Sequential-Color Displays,", SID Digest '04 : SID International Symposium Digest of Technical Papers, 2004, vol. 35, pp. 82-85.

* cited by examiner

METHOD FOR DRIVING LIQUID CRYSTAL DISPLAY DEVICE

BACKGROUND OF THE INVENTION

1. Field of the Invention

One embodiment of the present invention relates to a liquid crystal display device, particularly a method for driving the liquid crystal display device.

2. Description of the Related Art

Display devices typified by liquid crystal display devices including liquid crystal elements, ranging from large display devices such as television receivers to small display devices such as cellular phones, have been spreading. From now on, products with higher-value added will be needed and are being developed.

A way to realize higher-value added is to achieve higher performance of pixel driving by increasing the number of data lines which supply an image signal to each pixel in a liquid crystal display device. Patent Document 1, for example, discloses a liquid crystal display device provided with a plurality of types of data lines. Specifically, Patent Document 1 discloses a configuration in which each of the plurality of types of data lines is connected to transistors in pixels (see FIGS. 2A to 2D).

REFERENCE

Patent Document

[Patent Document 1] Japanese Published Patent Application No. 2003-186451

SUMMARY OF THE INVENTION

A configuration of a liquid crystal display device and a method for driving the same will be first described with reference to FIGS. 10A to 10E for the description of an object of one embodiment of the present invention.

FIG. 10A is a block diagram of the liquid crystal display device. FIG. 10A illustrates a configuration in which a single data line (signal line) supplies the image signal to pixels.

FIG. 10A illustrates the liquid crystal display device including a pixel area 901, a scan line driver circuit 902, and a data line driver circuit (signal line driver circuit) 903. The scan line driver circuit 902 supplies a signal for selecting pixels 905 via n (n is a natural number of 2 or more) scan lines 904 each dedicated to the pixels in one row. The data line driver circuit 903 supplies image signals to pixels via m (m is a natural number of 2 or more) data lines 906 each dedicated to the pixels in one column.

FIG. 10B simply shows the sequence of supply of image signals to the pixels in the pixel area 901. Referring to FIG. 10B, as indicated by arrows 911, the pixels in the first row are selected with the scan line 904, so that image signals are supplied to the pixels in the first to m-th columns; and the pixels in the n-th row are selected with the scan line 904, so that image signals are supplied to the pixels in the first to m-th columns; thus, the image signals are supplied to all of the pixels 905. Supply of the image signals to the pixels in the pixel area 901 takes a time comparable to one frame period.

A liquid crystal display device requires AC drive in which the voltage of an image signal to be applied to liquid crystal is inverted in order to prevent liquid crystal from being degraded by application of either positive voltage or negative voltage. Examples of AC drive include gate-line inversion drive, source-line inversion drive, and frame inversion drive.

Frame inversion drive provides a frame period which alternates between a period of positive voltage application and a period of negative voltage application as shown in FIG. 10C where a positive voltage and a negative voltage are represented by "+" and "−", respectively. Note that a positive voltage and a negative voltage here are based on a relative magnitude relation between one voltage and common voltage which is the voltage of a counter electrode and serves as reference voltage.

FIG. 10D simply shows a transition of the frame period between a period of positive voltage application and a period of negative voltage application, which is described with reference to FIG. 10B and FIG. 10C. As shown in FIG. 10D, the transition of the frame period is done after a data line driver circuit 903 completes the supply of an image signal with positive voltage to the pixels in the n-th row via the data lines 906. Then, the data line driver circuit 903 supplies an image signal with negative voltage to the pixels in the first row via the data lines 906.

FIG. 10E shows the voltages of data lines in a given column in FIG. 10D. Here, the vertical axis and the horizontal axis represent the voltage (V) and the time (T), respectively. In FIG. 10E, "V+" indicates the maximum voltage that appears during the application of positive voltage to liquid crystal; "Vcom", common voltage applied to the counter electrode; and "V−", the minimum voltage that appears during the application of negative voltage to liquid crystal. As shown in FIG. 10E, a significant voltage change indicated by "ΔV" occurs at the time of supplying image signals with negative voltages to the pixels in the first row after the supply of image signals with positive voltages to the pixels in the n-th row is completed. Consequently, insufficient voltage change such as that indicated by a dotted line 921 may occur. In case of increase in liquid crystal display device size or operating speed, in particular, a region undergoing such insufficient voltage change is noticeable.

However, such a region undergoing the insufficient change in voltage can be brought out of sight of the viewer by, because such a region undergoing insufficient voltage change correspond to the pixels in the first row in the case shown in FIGS. 10A to 10E, placing pixels supposed to be in the first row (dummy pixels) in a region in the pixel area 901 which the viewer cannot see, in order to prevent the pixels in the first row from being a region in the pixel area 901 which can be seen by the viewer. In the case shown in FIGS. 10A to 10E, the pixels 905 in the first row which correspond to the region undergoing the insufficient change in voltage is present at the edge of the pixel area 901, so that the viewer has no problem actually seeing the pixel area even in case of insufficient voltage change at the time of the transition of the frame period.

Now, the case of increasing, as in Patent Document 1, the number of types of data lines each of which is dedicated to the pixels in one column in a liquid crystal display device will be described. In other words, a configuration in which a plurality of rows is simultaneously selected with scan lines and different image signals are supplied to the pixels with different types of data lines will be described below.

FIG. 11A is a block diagram of a liquid crystal display device. FIG. 11A shows the case where two types of data lines dedicated to the pixels in one column in the liquid crystal display device are used and different image signals are simultaneously supplied to the pixels in the same column via two types of data lines.

FIG. 11A shows a liquid crystal display device including the pixel area 901, the scan line driver circuit 902, and the data line driver circuit 903. The scan line driver circuit 902 supplies a signal for selecting the pixels 905 via 2n (n is a natural number of two or more) rows of scan lines 904 each dedicated to the pixels in one row. The data line driver circuit 903 supplies image signals to the pixels via m first data lines 906A each dedicated to the pixels in one of m columns and via m second data lines 906B each dedicated to the pixels in one of the m columns. Note that the pixel area 901 is divided into two regions (a region 907A and a region 907B). Each region has a plurality of pixels arranged in a matrix (n rows and m columns).

Each of the scan lines 904 is electrically connected to m pixels in one row which are included in the plurality of pixels 905 arranged in a matrix (2n rows and m columns) in the pixel area 901. Each of the first data lines 906A is connected to n pixels in one column which are included in the plurality of pixels 905 arranged in a matrix (n rows and m columns) in the region 907A. Each of the second data lines 906B is connected to n pixels in one column which are included in the plurality of pixels 905 arranged in a matrix (n rows and m columns) in the region 907B.

Like FIG. 10B, FIG. 11B simply shows the sequence of supply of image signals to the pixels 905. Referring to FIG. 11B, as indicated by arrows 912, the pixels in the first row are firstly selected with the scan line 904, so that image signals are supplied to the pixels in the first to m-th columns; and the pixels in the n-th row are finally selected with the scan line 904, so that image signals are supplied to the pixels in the first to m-th columns; thus, the image signals are supplied to all of the pixels in the region 907A. Referring to FIG. 11B, as indicated by arrows 913, the pixels in the (n+1)-th row are firstly selected with the scan line 904, so that image signals are supplied to the pixels in the first to m-th columns; and the pixels in the 2n-th row are finally selected with the scan line 904, so that image signals are supplied to the pixels in the first to m-th columns; thus, the image signals are supplied to all of the pixels in the region 907B. This is done simultaneously with the supply of the image signals to the pixels in the region 907A. Supply of the image signals to the pixels in the regions 907A and 907B takes a time comparable to one frame period.

As described with reference to FIG. 10C, a liquid crystal display device requires AC drive in which the voltage of an image signal to be applied to liquid crystal is inverted in order to prevent liquid crystal from being degraded by application of either positive voltage or negative voltage. Therefore, a period of positive voltage application and a period of negative voltage application appear in turn.

FIG. 11C shows a transition of the frame period between a period of positive voltage application and a period of negative voltage application, which is described with reference to FIG. 11B. As shown in FIG. 11C, the transition of the frame period is done after a data line driver circuit 903 completes the supply of image signals with positive voltages to the pixels in the n-th row via the first data lines 906A. Then, the data line driver circuit 903 supplies image signals with negative voltages to the pixels in the first row via the first data lines 906A. In addition, as shown in FIG. 11C, the transition of the frame period is done after a data line driver circuit 903 completes the supply of image signals with positive voltages to the pixels in the 2n-th row via the second data lines 906B. Then, the data line driver circuit 903 supplies image signals with negative voltages to the pixels in the (n+1)-th row via the second data lines 906B.

FIG. 11D shows the voltages of data lines in a given column in FIG. 11C. Here, as in FIG. 10E, the vertical axis and the horizontal axis represent the voltage (V) and the time (T), respectively. FIG. 11D particularly shows the voltage of the second data line 906B supplying image signals to the pixels in the region 907B. Note that the voltage of the first data line 906A supplying image signals to the pixels in the region 907A is similar to the voltage shown in FIG. 10E.

As shown in FIG. 11D, a significant voltage change indicated by "ΔV" occurs, as in FIG. 10E, at the time of supplying image signals with negative voltages to the pixels in the (n+1)-th row after the supply of image signals with positive voltages to the pixels in the 2n-th row included in the region 907B is completed. Consequently, insufficient voltage change such as that indicated by a dotted line 922 may occur. In case of increase in liquid crystal display device size or operating speed, in particular, a region undergoing such insufficient voltage change is noticeable.

Here, FIG. 11D is different from FIG. 10E in that it shows the pixels in the (n+1)-th row undergoing insufficient voltage change which are placed near the center of the pixel area 901. Consequently, when the transition of the frame period involves insufficient voltage change, the viewer sees it as a display defect. Moreover, in this case, unlike in the case shown in FIG. 10E, the region undergoing insufficient voltage change corresponds to the pixels in the (n+1)-th row; therefore, dummy pixels cannot be placed in the (n+1)-th row. For this reason, it is difficult to bring the region undergoing insufficient voltage change out of sight of the viewer, so that the viewer sees a display defect.

In view of this, an object of one embodiment of the present invention is to provide a method for driving a liquid crystal display device including a step of supplying image signals which are used to conduct inversion drive, simultaneously to pixels placed in different regions via a plurality of types of data lines dedicated to the pixels in one column This method can reduce display defects due to insufficient voltage change that occurs in the data lines.

One embodiment of the present invention provides a method for driving a liquid crystal display device including the steps of supplying first image signals used to apply positive voltages to liquid crystal to pixels via a first and second data lines during a first period; deselecting the pixels with scan lines to supply second image signals used to apply negative voltages to liquid crystal which is to be supplied to the pixels in the first row to first data lines and supply the second image signals used to apply negative voltages to the liquid crystal which is to be supplied to the pixels in the (n+1)-th row to second data lines during a second period; and supplying the second image signals used to apply negative voltages to the liquid crystal to the pixels via the first and second data lines during a third period.

One embodiment of the present invention is a method for driving a liquid crystal display device. The liquid crystal display device is configured to be supplied with first image signals used to apply positive voltages to liquid crystal and second image signals used to apply negative voltages to the liquid crystal with first data lines and second data lines each dedicated to pixels in one row, and to display an image by sequentially selecting scan lines connected to the pixels in the first to n-th rows (n is a natural number of 2 or more) to supply the first image signals or second image signals to the pixels in the first to n-th rows with the first data lines and, simultaneously, by sequentially selecting scan lines connected to the pixels in the (n+1)-th to 2n-th rows to supply the first image signals or the second image signals to the pixels in the (n+1)-th to 2n-th rows with the second data lines. The method includes the steps of: selecting the pixels with the scan lines connected to the pixels in the first to n-th rows and the scan lines connected to the pixels in the (n+1)-th to 2n-th rows to supply the first image signals to the pixels with the first data lines and the second data lines during a first period; deselecting the pixels with the scan lines connected to the pixels in the first to n-th rows and the scan lines connected to the pixels in the (n+1)-th to 2n-th rows to supply the second image signals supplied to the pixels in the first row to the first data lines and supply the second image signals supplied to the pixels in the (n+1)-th row to the second data lines during a second period; and selecting the pixels with the scan lines connected to the pixels in the first to n-th rows and the scan lines connected to the pixels in the (n+1)-th to 2n-th rows to supply the second image signals to the pixels with the first data lines and the second data lines during a third period.

Another embodiment of the present invention may be a method for driving the liquid crystal display device, in which, during the second period placed between the first period and the third period, the pixels are deselected with the scan lines connected to the pixels in the first to n-th rows and the scan lines connected to the pixels in the (n+1)-th to 2n-th rows, and step in which the second image signals supplied to the pixels in the first row is supplied to the first data lines and the second image signals supplied to the pixels in the (n+1)-th row is supplied to the second data lines is performed more than once.

Another embodiment of the present invention is a method for driving a liquid crystal display device. The liquid crystal display device is configured to be supplied with first image signals used to apply positive voltages to liquid crystal and second image signals used to apply negative voltages to the liquid crystal with first to third data lines each dedicated to pixels in one row, and to display an image by sequentially selecting scan lines connected to the pixels in the first to n-th rows (n is a natural number of 2 or more) to supply the first image signals or second image signals to the pixels in the first to n-th rows with the first data lines and, simultaneously, sequentially selecting scan lines connected to the pixels in the (n+1)-th to 2n-th rows to supply the first image signals or the second image signals to the pixels in the (n+1)-th to 2n-th rows with the second data lines and, still simultaneously, selecting scan lines connected to the pixels in the (2n+1)-th to 3n-th rows to supply the first image signals or the second image signals to the pixels in the (2n+1)-th to 3n-th rows with the third data lines. The method includes the steps of: selecting the pixels with the scan lines connected to the pixels in the first to n-th rows, the scan lines connected to the pixels in the (n+1)-th to 2n-th rows, and the scan lines connected to the pixels in the (2n+1)-th to 3n-th rows to supply the first image signals to the pixels with the first to third data lines during a first period; deselecting the pixels with the scan lines connected to the pixels in the first to n-th rows, the scan lines connected to the pixels in the (n+1)-th to 2n-th rows, and the scan lines connected to the pixels in the (2n+1)-th to 3n-th rows to supply the second image signals supplied to the pixels in the first row to the first data lines, supply the second image signals supplied to the pixels in the (n+1)-th row to the second data lines, and supply the second image signals supplied to the pixels in the (2n+1)-th row to the third data lines during a second period; and selecting the pixels with the scan lines connected to the pixels in the first to n-th rows, the scan lines connected to the pixels in the (n+1)-th to 2n-th rows, and the scan lines connected to the pixels in the (2n+1)-th to 3n-th rows to supply the second image signals to the pixels with the first to third data lines during a third period.

Another embodiment of the present invention may be a method for driving the liquid crystal display device, including a period during which light sources in a backlight are lit after supply of the first image signals or the second image signals during the first period or the third period.

Another embodiment of the present invention may be a method for driving the liquid crystal display device, in which the light sources in the backlight are a red light source, a green light source, and a blue light source.

Another embodiment of the present invention may be a method for driving the liquid crystal display device, in which image signals based on light sources of different colors are supplied to the pixels in the first to n-th rows, the pixels in the (n+1)-th to 2n-th rows, and the pixels in the (2n+1)-th to 3n-th rows.

Another embodiment of the present invention may be a method for driving the liquid crystal display device, in which, during the second period placed between the first period and the third period, the pixels are deselected with the scan lines connected to the pixels in the first to n-th rows, the scan lines connected to the pixels in the (n+1)-th to 2n-th rows, and the scan lines connected to the pixels in the (2n+1)-th to 3n-th rows, and operation in which the second image signals supplied to the pixels in the first row is supplied to the first data lines, the second image signals supplied to the pixels in the (n+1)-th row is supplied to the second data lines, and the second image signals supplied to the pixels in the (2n+1)-th row is supplied to the third data lines is performed more than once.

According to one embodiment of the present invention, display defects can be reduced by a method for driving a liquid crystal display device including a step of supplying image signals which are used to conduct inversion drive, simultaneously to pixels placed in different regions via a plurality of types of data lines dedicated to the pixels in one column.

DETAILED DESCRIPTION OF THE INVENTION

Figure 1A:
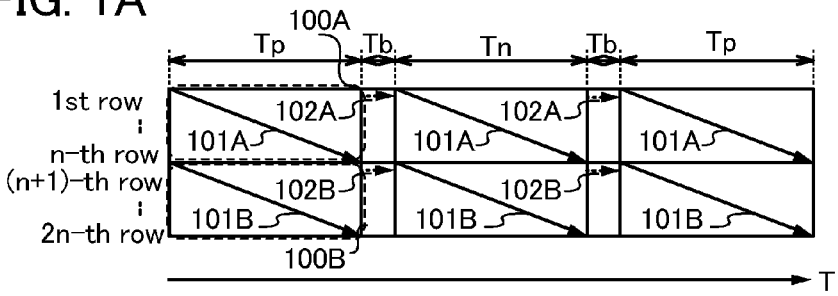
FIGS. 1A to 1D are diagrams to describe Embodiment 1.

Embodiments of the present invention will be described below in detail with reference to the drawings. Note that the present invention can be implemented with various modes. It will be readily appreciated by those skilled in the art that modes and details of the present invention can be modified in various ways without departing from the spirit and scope of the present invention. Therefore, the present invention should not be construed as necessarily being as described in the embodiments below. Note that, in the structure of the present invention described below, identical objects in all the drawings are denoted by the same reference numeral.

Note that, the size, layer thickness, and signal waveform of each object shown in the drawings and the like in the embodiments are exaggerated for simplicity in some cases. Each object therefore is not necessarily in such scales.

Note that, in this specification, terms such as "first", "second", "third", to "n-th (n is a natural number)" are used only for preventing confusion between components, and thus do not limit numbers.

Embodiment 1

In this embodiment, a method for driving a liquid crystal display device in one embodiment of the present invention will be described. In this embodiment, a liquid crystal display device in which two types of data lines: the first data line and the second data line, are used as such a plurality of types of data lines used to supply different image signals simultaneously to the pixels in the same column is taken as an example.

The driving method in this embodiment employs the frame period that alternates between a period in which image signals used to apply positive voltages to liquid crystal (first image signals) and a period in which image signals used to apply negative voltages to liquid crystal (second image signals), i.e., image signals used to conduct inversion drive with the first data line and the second data line. Between a period in which the first image signals are supplied to the pixels (a first period) and a period in which the second image signals are supplied to the pixels (a third period), a gap period (a second period) for reliably giving desirable change to the voltages of the first data lines and the second data lines at the transition between the first period and the third period is placed.

Note that the case during the first period or the third period, where an image signal is supplied to a pixel via a data line may be expressed by the phrase "an image signal is fed to a pixel". Further, the case during the second period, where an image signal is supplied to a data line and a pixel is deselected via a scan line, causing the image signal on the data line to be not supplied to the pixel may be expressed by the phrase "an image signal is fed to a data line".

Note that a pixel corresponds to a display unit controlling the luminance of one color component (e.g., any one of R (red), G (green), and B (blue)). Therefore, in a color display device, the minimum display unit of a color image is composed of three pixels of an R pixel, a G pixel and a B pixel. Note that the color of the color elements is not necessarily of three varieties and may be of three or more varieties or may include a color other than RGB.

Note that voltage refers to a potential difference between a given potential and a reference potential (e.g., a ground potential) in many cases. Therefore, voltage can also be called potential or potential difference.

FIG. 1A is a conceptual diagram showing signal supply for a pixel area in the liquid crystal display device. FIG. 1A shows the first period (Tp in the drawing) and the third period (Tn in the drawing) where image signals are supplied to pixels alternately appear with the second period (Tb in the drawing) therebetween.

In FIG. 1A where the horizontal axis represents time T, arrows 101A indicate supply of image signals to the pixels in the first to n-th rows included in the region 100A within the pixel area during the first and third periods, while arrows 101B indicate supply of image signals to the pixels in the (n+1)-th to 2n-th rows included in the region 100B within the pixel area during the first and third periods. In other words, the arrows 101A and 101B in FIG. 1A show the scene where image signals are simultaneously supplied to the pixels included in the regions 100A and 100B during the first to third periods.

Although both the region 100A and the region 100B have n rows of pixels in this embodiment, they may have different number of rows of pixels instead.

During the first period in FIG. 1A, pixels are selected with the scan lines connected to the pixels in the first to n-th rows included in the region 100A within the pixel area, and then the first image signals are supplied to the selected pixels via the first data lines. Further, during the first period in FIG. 1A, pixels are selected with the scan lines connected to the pixels in the (n+1)-th to 2n-th rows included in the region 100B within the pixel area, and then the first image signals are supplied to the selected pixels via the second data lines.

During the third period in FIG. 1A, as during the first period Tp, pixels are selected with the scan lines connected to the pixels in the first to n-th rows included in the region 100A within the pixel area, and then the second image signals are supplied to the selected pixels via the first data lines. Further, during the third period in FIG. 1A, pixels are selected with the scan lines connected to the pixels in the (n+1)-th to 2n-th rows included in the region 100B within the pixel area, and then the second image signals are supplied to the selected pixels via the second data lines.

In FIG. 1A, dotted arrows 102A indicate supply of first image signals to the data lines included in the region 100A within the pixel area during the second period, while dotted arrows 102B indicate supply of second image signals to the data lines included in the region 100B. In other words, the dotted arrows 102A and 102B in FIG. 1A show the scene where image signals are simultaneously supplied to the data lines included in the regions 100A and 100B during the second period.

Now, the second period which is placed between the first period and the third period will be described with drawings. As an example, a driving method with a cycle of the first period Tp, followed by the second period Tb, followed by the third period Tn will be described.

Alternatively, the driving method may employ a cycle of the third period Tn, followed by the second period Tb, followed by the first period Tp. In this case, similar drive can be done by inverting as appropriate the polarities of image signals to be input to the pixels, for example.

Figure 1B:
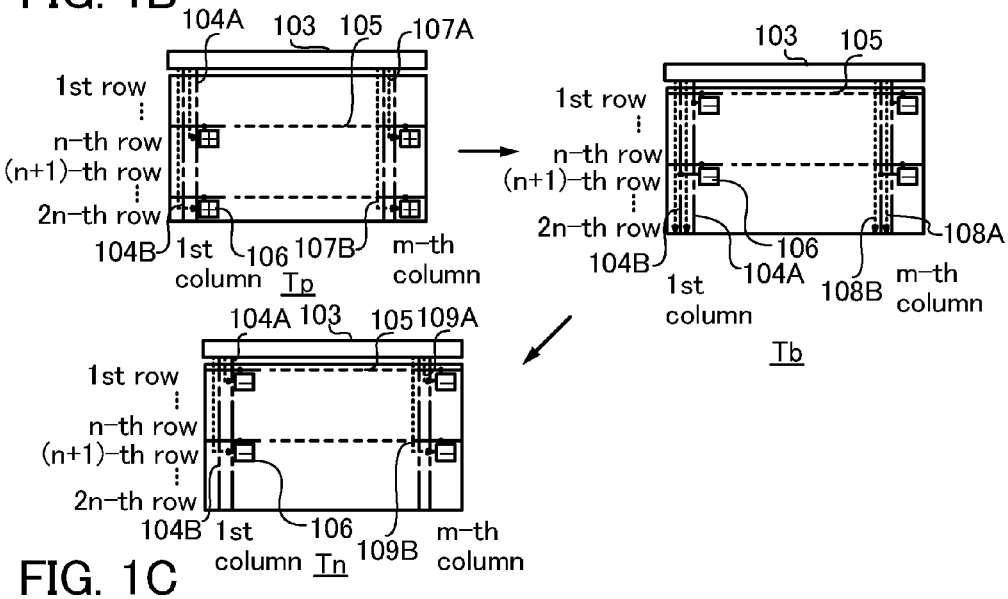

FIG. 1B visualizes supply of image signals to the data line during the first period Tp, the second period Tb, and the third period Tn shown in FIG. 1A, and the polarities (positive or negative) of the voltages of image signals supplied to the pixels. In addition, FIG. 1B is a diagram where the voltage of the first image signal and the voltage of the second image signal used to conduct frame inversion drive are represented by "+" and "−", respectively, showing the behavior of the liquid crystal display device during a period during which the transition of the frame period is done.

FIG. 1B shows the behavior of the liquid crystal display device during the first period Tp where the data line driver circuit 103 supplies the first image signals for the pixels 106 in the n-th row to first data lines 104A, and the first image signals for the pixels 106 in the 2n-th row to second data lines 104B, and then the pixels 106 in the n-th and 2n-th rows are selected with the scan lines 105, so that the signals are supplied to the pixels 106. In FIG. 1B, the first image signals supplied to the pixels 106 in the n-th row via the first data lines 104A are represented by dotted line arrows 107A. Further, in FIG. 1B, the first image signals supplied to the pixels 106 in the 2n-th row via the second data lines 104B are represented by dotted line arrows 107B.

FIG. 1B also shows the behavior of the liquid crystal display device during the second period Tb following the first period Tp, where the data line driver circuit 103 supplies the second image signals, which are to be supplied to the pixels in the first row during the third period Tn, to the first data lines 104A, and the second image signals, which are to be supplied to the pixels in the (n+1)-th row during the third period Tn, to the second data lines 104B, and then all the scan lines are deselected, so that the signals are not supplied to the pixels 106. In FIG. 1B, the second image signals, which are to be supplied to the pixels in the first row, supplied to the first data lines 104A are represented by dotted line arrows 108A. Further, in FIG. 1B, the first image signals, which are to be supplied to the pixels in the (n+1)-th row, supplied to the first data lines 104B are represented by dotted line arrows 108B.

FIG. 1B shows the behavior of the liquid crystal display device during the third period Tn following the second period Tb, where the data line driver circuit 103 supplies the second image signals for the pixels 106 in the first row to the first data lines 104A, and the second image signals for the pixels 106 in the (n+1)-th row to the second data lines 104B, and then the pixels 106 in the first and (n+1)-th rows are selected with the scan lines 105, so that the signals are supplied to the pixels 106. In FIG. 1B, the second image signals supplied to the pixels 106 in the first row via the first data lines 104A are represented by dotted line arrows 109A. Further, in FIG. 1B, the second image signals supplied to the pixels 106 in the (n+1)-th row via the second data lines 104B are represented by dotted line arrows 109B.

Figure 1C:
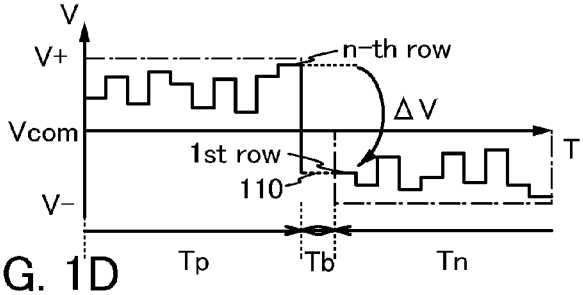

FIG. 1C shows the voltages of the first data lines 104A in a given column in FIG. 1B during the first to third periods. Here, the vertical axis and the horizontal axis represent the voltage (V) and the time (T), respectively. In FIG. 1C, "V+" indicates the maximum voltage that appears during the application of positive voltage to liquid crystal, "Vcom", common voltage applied to the counter electrode, and "V−", the minimum voltage that appears during the application of negative voltage to liquid crystal.

During the first period Tp shown in FIG. 1C, the first image signals are firstly supplied to the pixels in the first row and then sequentially to the pixels in the second to n-th rows. During the following second period Tb shown in FIG. 1C, the second image signals, which are to be supplied to the pixels in the first row during the third period Tn, are supplied to the first data lines. During the following third period Tn shown in FIG. 1C, the second image signals are supplied firstly to the pixels in the first row and then sequentially to the pixels in the second to n-th rows.

For voltage changes during the first to third periods shown in FIG. 1C, as indicated by "Δ V" in FIG. 1C, significant voltage change occurs between the first period and the third period particularly when the second image signals are supplied to the pixels in the first row. Accordingly, the second period during which the second image signals to be supplied to the pixels in the first row during the third period Tn are supplied to the first data lines in advance is provided to make the voltage change occur prior to the third period as shown by a dotted line 110. Consequently, during the third period Tn shown in FIG. 1C, the first data lines have a negative voltage from the start, so that display defects due to insufficient change in the voltage of the first data lines can be reduced when the second image signals are firstly supplied to the pixels in the first row.

Figure 1D:
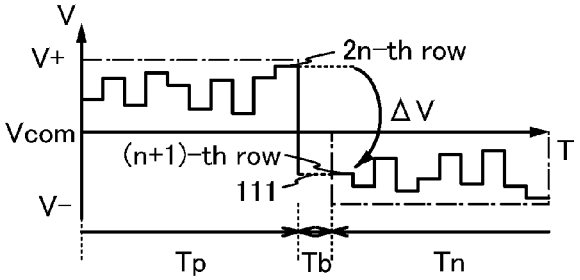

Like FIG. 1C, FIG. 1D shows the voltages of the data lines 104B in a given column in FIG. 1B. Here, the vertical axis and the horizontal axis represent the voltage (V) and the time (T), respectively. As in FIG. 1C, In FIG. 1D, "V+" indicates the maximum voltage that appears during the application of positive voltage to liquid crystal, "Vcom", common voltage applied to the counter electrode, and "V−", the minimum voltage that appears during the application of negative voltage to liquid crystal.

During the first period Tp shown in FIG. 1D, the first image signals are firstly supplied to the pixels in the (n+1)-th row and then sequentially to the pixels in the (n+2)-th to 2n-th rows. During the following second period Tb shown in FIG. 1D, the second image signals, which are to be supplied to the pixels in the (n+1)-th row during the third period Tn, are supplied to the second data lines. During the following third period Tn shown in FIG. 1D, the second image signals are supplied firstly to the pixels in the (n+1)-th row and then sequentially to the pixels in the (n+2)-th to n-th rows.

For voltage changes during the first to third periods shown in FIG. 1D, as indicated by "Δ V" in FIG. 1D, significant voltage change occurs between the first period and the third period particularly when the second image signals are supplied to the pixels in the (n+1)-th row. Accordingly, the second period, during which the second image signals to be supplied to the pixels in the (n+1)-th row during the third period Tn are supplied to the second data lines in advance, is provided to make the voltage change occur prior to the third period as shown by a dotted line 111. Consequently, during the third period Tn shown in FIG. 1D, the second data lines have negative voltages from the start, so that display defects due to insufficient change in the voltage of the second data lines can be reduced when the second image signals are firstly supplied to the pixels in the (n+1)-th row.

Note that FIGS. 1C and 1D show the behavior of the liquid crystal display device which prevents insufficient change in the voltages of the second image signals to be supplied to the pixels in the first and (n+1)-th rows during the third period. The driving method in this embodiment, in particular, is effective in preventing insufficient change in the voltages of the second data lines connected to the pixels in the (n+1)-th row placed near the center of the pixel area. Specifically, the pixels in the (n+1)-th row placed near the center of the pixel area, in particular, are portions in which the viewer is likely to see display defects and dummy pixels are difficult to provide; thus, the driving method in one embodiment of the present invention is very effective in reducing the display defects.

For the driving method in one embodiment of the present invention, in case of increase in liquid crystal display device size or operating speed, in particular, a region undergoing such insufficient voltage change is noticeable. Therefore, the driving method in one embodiment of the present invention is particularly effective in large-sized liquid crystal display devices or liquid crystal display devices which require high-seed operation.

Next, the pixel area including the region 100A and the region 100B that is described with FIG. 1A will be described in detail with reference to FIGS. 2A to 2D.

Figure 2A:
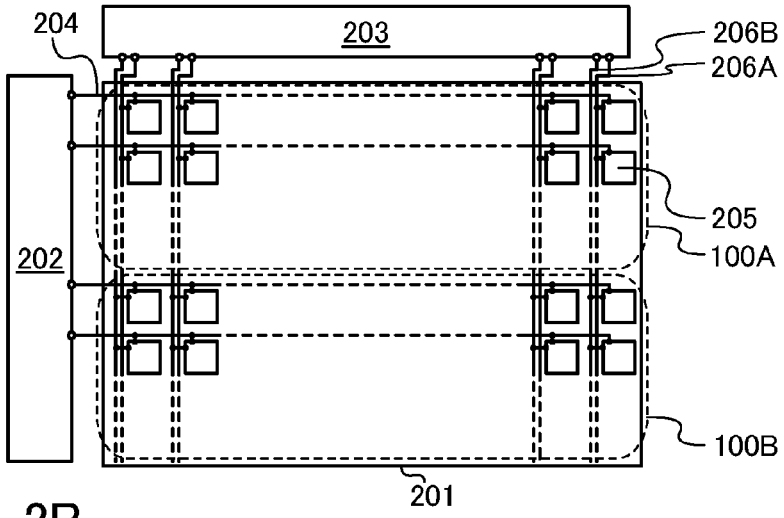
FIGS. 2A to 2D are diagrams to describe Embodiment 1.

FIG. 2A is a block diagram of a liquid crystal display device. FIG. 2A shows the case where two types of data lines dedicated to the pixels in one column in the liquid crystal display device are used and different image signals are simultaneously supplied to the pixels in the same column via two types of data lines.

FIG. 2A shows a liquid crystal display device including the pixel area 201, the scan line driver circuit 202, and the data line driver circuit 203. The scan line driver circuit 202 supplies a signal for selecting the pixels 205 via 2n (n is a natural number of two or more) rows of scan lines 204 each dedicated to the pixels in one row. The data line driver circuit 203 supplies image signals to the pixels via m first data lines 206A each dedicated to the pixels in one of m columns and via m second data lines 206B each dedicated to the pixels in one of the m columns. Note that the pixel area 201 is divided into two regions (a region 100A and a region 100B). Each region has a plurality of pixels arranged in a matrix (n rows and m columns).

Each of the scan lines 204 is electrically connected to m pixels in one row which are included in the plurality of pixels 205 arranged in a matrix (2n rows and m columns) in the pixel area 201. Each of the first data lines 206A is connected to n pixels in one column which are included in the plurality of pixels 205 arranged in a matrix (n rows and m columns) in the region 100A. Each of the second data lines 206B is connected to n pixels in one column which are included in the plurality of pixels 205 arranged in a matrix (n rows and m columns) in the region 100B.

Figure 2B:
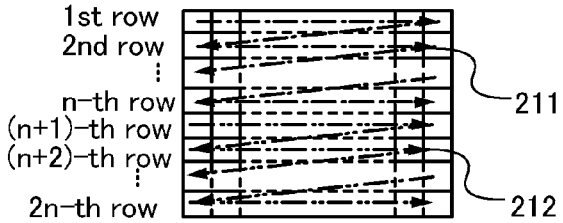

FIG. 2B simply shows the sequence of supply of image signals to the pixels 205. Referring to FIG. 2B, as indicated by arrows 211, the pixels in the first row are firstly selected with the scan line 204, so that image signals are supplied to the pixels in the first to m-th columns; and the pixels in the n-th row are finally selected with the scan line 204, so that image signals are supplied to the pixels in the first to m-th columns; thus, the image signals are supplied to all of the pixels in the region 100A. Referring to FIG. 2B, as indicated by arrows 212, the pixels in the (n+1)-th row are firstly selected with the scan line 204, so that image signals are supplied to the pixels in the first to m-th columns; and the pixels in the 2n-th row are finally selected with the scan line 204, so that image signals are supplied to the pixels in the first to m-th columns; thus, the image signals are supplied to all of the pixels in the region 100B. This is done simultaneously with the supply of the image signals to the pixels in the region 100A. Supply of the image signals to the pixels in the regions 100A and 100B takes a time comparable to one frame period.

Figure 2C:
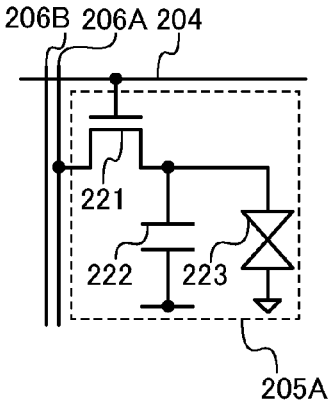
Figure 2D:
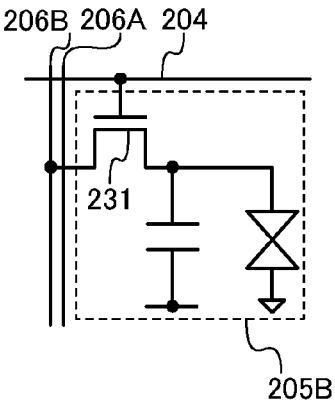

FIGS. 2C and 2D show examples of circuit configurations of the pixels 205. Specifically, FIG. 2C shows an example of a circuit configuration of the pixel 205 placed in the region 100A shown in FIG. 2A, and FIG. 2D shows an example of a circuit configuration of the pixel 205 placed in the region 100B shown in FIG. 2A.

The pixel 205A illustrated in FIG. 2C includes a transistor 221, a capacitor 222, and a liquid crystal element 223. A gate terminal of the transistor 221 is connected to the scan line 204. One terminal of a source and a drain of the transistor 221 is connected to the first data line 206A. One electrode of the capacitor 222 is connected to the other terminal of the source and drain of the transistor 221. The other electrode of the capacitor 222 is connected to a capacitor line. One electrode (a pixel electrode) of the liquid crystal element 223 is connected to the other terminal of the source and the drain of the transistor 221 and one electrode of the capacitor 222. The other electrode (a counter electrode) of the liquid crystal element 223 is connected to a wiring for supplying a common voltage.

A pixel 205B illustrated in FIG. 2D has the same circuit configuration as the pixel 205A illustrated in FIG. 2C. Note that the pixel 205B illustrated in FIG. 2D is different from the pixel 205A illustrated in FIG. 2C in that one of a source and a drain of a transistor 231 is connected not to the first data line 206A but the second data line 206B.

Note that a transistor is an element having at least three terminals of a gate, a drain, and a source. The transistor includes a channel region between a drain region and a source region, and current can flow through the drain region, the channel region, and the source region. Here, since the source and the drain of the transistor may change depending on the structure, the operating condition, and the like of the transistor, it is difficult to specify which is the source (or the drain). Thus, in this specification, a region functioning as a source or a drain is not called the source or the drain in some cases. In such a case, one of the source and the drain is referred to as one terminal and the other thereof is referred to as the other terminal in some cases. Alternatively, one of the source and the drain may be referred to as a first electrode (terminal) and the other thereof may be referred to as a second electrode (terminal). Further alternatively, one of the source and the drain may be referred to as a source region and the other thereof may be referred to as a drain region. Still further alternatively, one of the source and the drain may be referred to as a source terminal and the other thereof may be referred to as a drain terminal.

The structure of a transistor provided in a pixel may be an inverted staggered structure or a staggered structure. Alternatively, a double-gate structure may be used in which a channel region is divided into a plurality of regions and the divided channel regions are connected in series. Alternatively, a dual-gate structure may be used in which gate electrodes are provided over and under the channel region. Further alternatively, a transistor element in which a semiconductor layer forming the transistor is a plurality of island-shaped semiconductor layers to realize switching operation may be used.

Next, the first image signals or the second image signals supplied to the first data lines and the second data lines which have been described with reference to FIGS. 1A to 1D, and the selection of the scan line will be described with drawings. In other words, whether or not image signals supplied to the first data lines and the second data lines are supplied to the pixels in the row selected as a result of the selection of the scan line will be described with drawings.

Figure 3A:
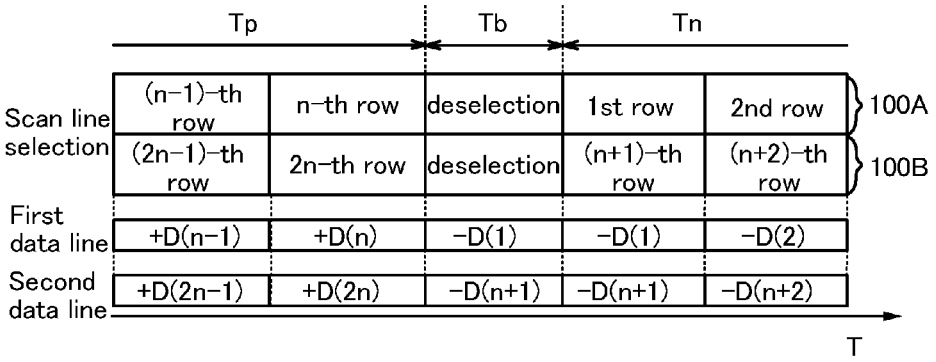
FIGS. 3A and 3B are diagrams to describe Embodiment 1.

The selection of the scan line during the first period Tp, the second period Tb, and the third period Tn, and image signals supplied to the first data lines and image signals supplied to the second data lines will be described with reference to FIG. 3A. In the section "Scan line selection" in FIG. 3A, the upper case shows the state of the region 100A in the pixel area described with reference to FIGS. 1A to 1D, while the lower case shows the state of the region 100B in the pixel area described with reference to FIGS. 1A to 1D. Further, the section "Scan line selection" in FIG. 3A indicates the rows that scan lines selected in each period belong and shows the fact that the scan lines are deselected during the second period Tb. The sections "First data line" and "Second data line" in FIG. 3A show to which rows image signals for the first data lines and image signals for the second data lines are supplied in accordance with the selection or deselection of the scan line, respectively. For example, an image signal supplied to the pixels in the first row is represented by D(1), and an image signal supplied to the pixels in the n-th row, D(n). In the drawing, "+" represents the first image signal used to apply positive voltage to liquid crystal, while "−" represents the second image signal used to apply negative voltage to liquid crystal.

As described with reference to FIGS. 1A to 1D, during the first period Tp shown in FIG. 1C, the first image signals are firstly supplied to the pixels in the first row and then sequentially to the pixels in the second to n-th rows. During the following second period Tb, the second image signals, which are to be supplied to the pixels in the first row during the third period Tn, are supplied to the first data lines. During the following third period Tn, the second image signals are supplied firstly to the pixels in the first row and then sequentially to the pixels in the second to n-th rows.

During the first period Tp shown in FIG. 1D, positive voltages are firstly supplied to the pixels in the (n+1)-th row and then sequentially to the pixels in the (n+2)-th to 2n-th rows. During the following second period Tb shown in FIG. 1D, the second image signals, which are to be supplied to the pixels in the (n+1)-th row during the third period Tn, are supplied to the second data lines. During the following third period Tn shown in FIG. 1D, the second image signals are supplied firstly to the pixels in the (n+1)-th row and then sequentially to the pixels in the (n+2)-th to n-th rows.

For voltage changes during the first to third periods, significant voltage change occurs between the first period and the third period particularly when the second image signals are supplied to the pixels in the first and (n+1)-th rows. Accordingly, the second period during which the second image signals to be supplied to the pixels in the first and (n+1)-th rows during the third period Tn are supplied to the first and second data lines in advance is provided to make the voltage change occur prior to the third period. Consequently, during the third period Tn, the first and second data lines have negative voltages from the start, so that display defects due to insufficient change in the voltage of the first and second data lines can be reduced when the second image signals are firstly supplied to the pixels in the first and (n+1)-th rows.

Figure 3B:
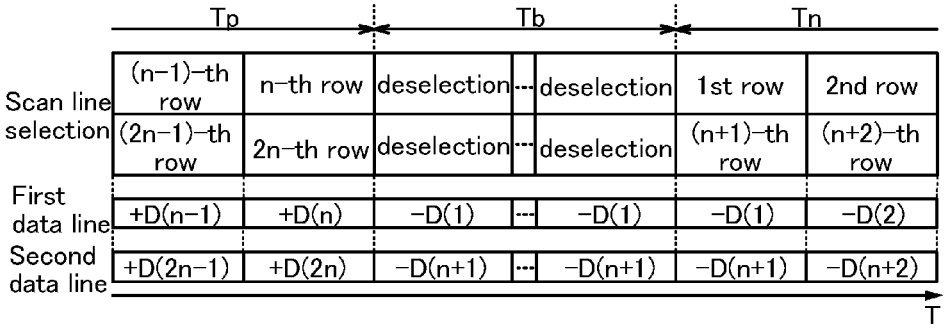

Note that the second period shown in FIG. 3A may be changeable in length and may be a period during which, as shown in FIG. 3B, the same image signals are supplied to the first data lines and the same image signals are supplied to the second data lines more than once. This allows changes in the voltages of the first and second data lines during the second period to reliably occur prior to the third period.

As stated above, the driving method in one embodiment of the present invention can prevent insufficient change in the voltages of the second image signals to be supplied to the pixels in the first and (n+1)-th rows during the third period. The driving method in this embodiment, in particular, is effective in preventing insufficient change in the voltages of the second data lines connected to the pixels in the (n+1)-th row placed near the center of the pixel area and thus can reduce display defects seen by the viewer.

This embodiment can be implemented in appropriate combination with any of the structures described in the other embodiments.

Embodiment 2

In this embodiment, an example of a liquid crystal display device employing the driving method in Embodiment 1 will be described with reference to FIGS. 4A to 4D, FIGS. 5A and 5B, FIGS. 6A and 6B, and FIG. 7, taking a field-sequential liquid crystal display device as an example.

Structural Example of Liquid Crystal Display Device

Figure 4A:
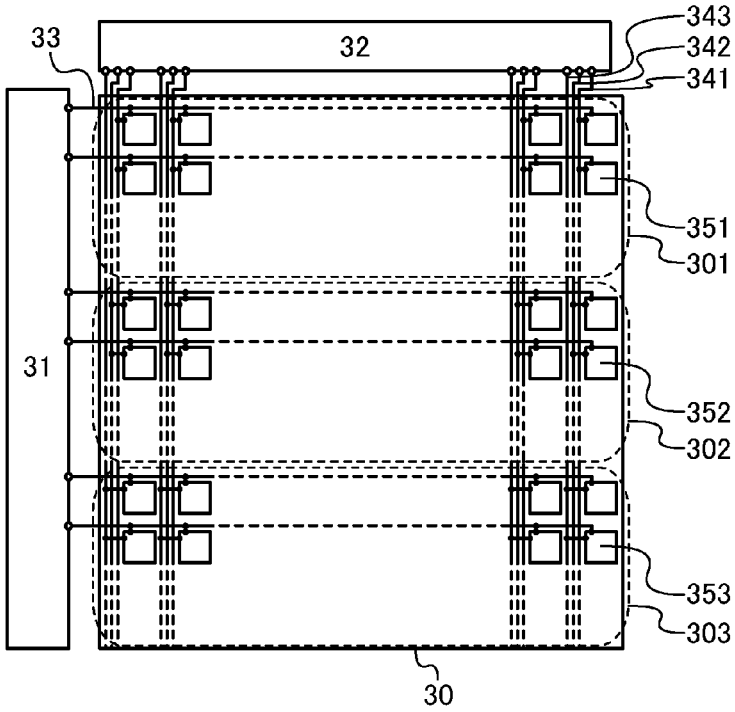
FIGS. 4A to 4D are diagrams to describe Embodiment 2.

FIG. 4A illustrates a structural example of a liquid crystal display device. The liquid crystal display device illustrated in FIG. 4A includes a pixel area 30; a scan line driver circuit 31; a data line driver circuit 32; 3n (n is a natural number of 2 or more) scan lines 33 which are arranged in parallel or substantially parallel to each other and whose potentials are controlled by the scan line driver circuit 31; and m (m is a natural number of 2 or larger) first data lines 341, m second data lines 342, and m third data lines 343 which are arranged in parallel or substantially parallel to each other and whose potentials are controlled by the data line driver circuit 32.

The pixel area 30 is divided into three regions (regions 301 to 303) and each region includes a plurality of pixels which is arranged in a matrix (n rows and m columns). Note that each of the scan lines 33 is connected to m pixels provided in a corresponding row among the plurality of pixels arranged in a matrix (3 sets of n rows and m columns) in the pixel area 30. In addition, each of the first data lines 341 is connected to n pixels provided in a corresponding column among the plurality of pixels 351 arranged in a matrix (n rows and m columns) in the region 301. Further, each of the second data lines 342 is connected to n pixels provided in a corresponding column among the plurality of pixels 352 arranged in a matrix (n rows and m columns) in the region 302. Furthermore, each of the third data lines 343 is connected to n pixels provided in a corresponding column among the plurality of pixels 353 arranged in a matrix (n rows and m columns) in the region 303.

Although both the region 301 and the region 303 have n rows of pixels in this embodiment, they may have different number of rows of pixels instead.

Note that a start signal (GSP) for the scan line driver circuit, the clock signal (GCK) for the scan line driver circuit, and power supply voltages such as high supply voltage and low supply voltage are input to the scan line driver circuit 31 from an external device. Further, signals such as the start signal (SSP) for the data line driver circuit, the clock signal (SCK) for the data line driver circuit, and image signals (data1 to data3), and power supply voltages such as high supply voltage and low supply voltage are input to the data line driver circuit 32 from the external device.

Figure 4B:
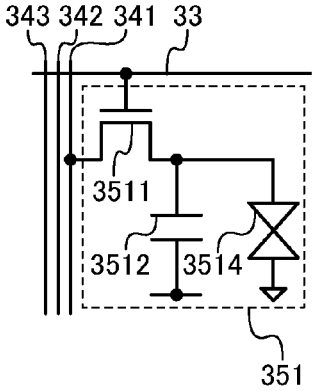
Figure 4C:
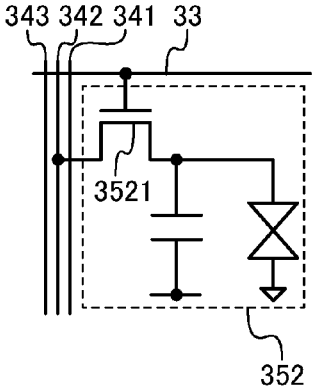
Figure 4D:
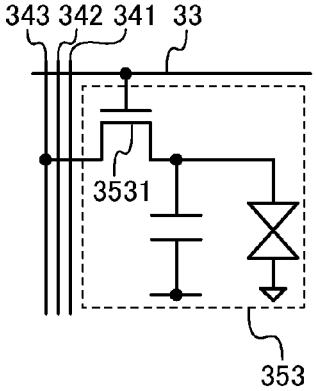

FIGS. 4B to 4D illustrate examples of circuit configurations of pixels. Specifically, FIG. 4B illustrates an example of the circuit configuration of a pixel 351 provided in the region 301; FIG. 4C illustrates an example of the circuit configuration of a pixel 352 provided in the region 302; and FIG. 4D illustrates an example of the circuit configuration of a pixel 353 provided in the region 303. The pixel 351 illustrated in FIG. 4B includes a transistor 3511, a capacitor 3512, and a liquid crystal element 3514. A gate terminal of the transistor 3511 is connected to the scan line 33. One terminal of a source and a drain of the transistor 3511 is connected to the first data line 341. One electrode of the capacitor 3512 is connected to the other terminal of the source and drain of the transistor 3511. The other electrode of the capacitor 3512 is connected to a capacitor line. One electrode (a pixel electrode) of the liquid crystal element 3514 is connected to the other terminal of the source and the drain of the transistor 3511 and one electrode of the capacitor 3512. The other electrode (a counter electrode) of the liquid crystal element 3514 is connected to wiring for supplying a counter potential.

The circuit configurations of the pixel 352 illustrated in FIG. 4C and the pixel 353 illustrated in FIG. 4D are the same as the structure of the pixel 351 illustrated in FIG. 4B. Note that the pixel 352 illustrated in FIG. 4C differs from the pixel 351 illustrated in FIG. 4B in that one of a source and a drain of a transistor 3521 is connected to the second data line 342 instead of the first data line 341; and the pixel 353 illustrated in FIG. 4D differs from the pixel 351 illustrated in FIG. 4B in that one of a source and a drain of a transistor 3531 is connected to the third data line 343 instead of the first data line 341.

Configuration Example of Scan Line Driver Circuit 31

Figure 5A:
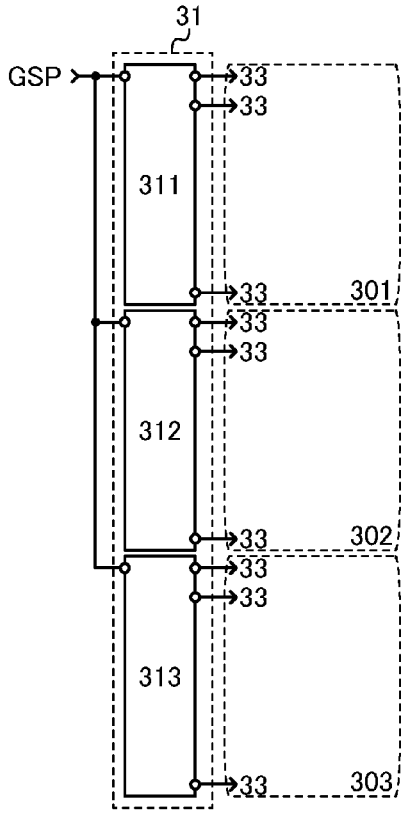
FIGS. 5A and 5B are diagrams to describe Embodiment 2.

FIG. 5A illustrates a configuration example of the scan line driver circuit 31 included in the liquid crystal display device illustrated in FIG. 4A. The scan line driver circuit 31 illustrated in FIG. 5A includes shift registers 311 to 313 each including n output terminals. Note that output terminals of the shift register 311 are connected to the respective n scan lines 33 provided in the region 301. Output terminals of the shift register 312 are connected to the respective n scan lines 33 provided in the region 302. Output terminals of the shift register 313 are connected to the respective n scan lines 33 provided in the region 303. In other words, the shift register 311 supplies scan signals (selection signals) to the region 301; the shift register 312 supplies scan signals to the region 302; and the shift register 313 supplies scan signals to the region 303. Specifically, the shift register 311 has a function of sequentially shifting scan signals (sequentially selecting the scan lines 33 every half the period of the clock signal (GCK) for the scan line driver circuit) from the scan line 33 in a first row in response to the start pulse signal (GSP) for the scan line driver circuit that is input from an external device. The shift register 312 has a function of sequentially shifting scan signals from the scan line 33 in the (n+1)-th row in response to the start pulse signal (GSP) for the scan line driver circuit that is input from the external device. The shift register 313 has a function of sequentially shifting scan signals from the scan line 33 in the (2n+1)-th row in response to the start pulse signal (GSP) for the scan line driver circuit that is input from the external device.

Operation Example of Scan Line Driver Circuit 31

Figure 5B:
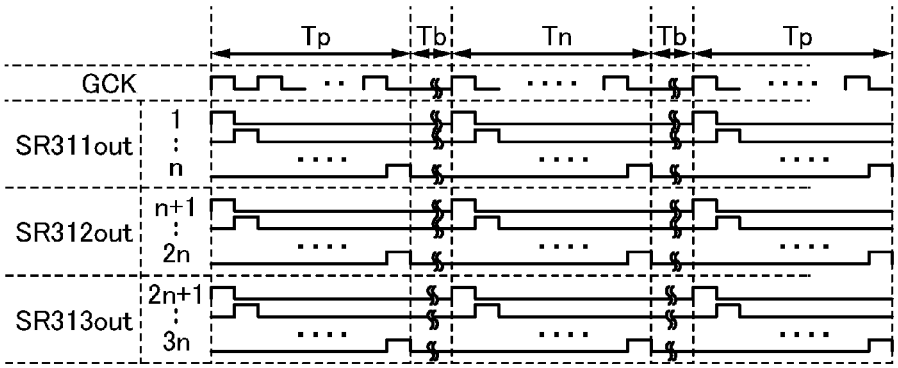

An operation example of the scan line driver circuit 31 will be described with reference to FIG. 5B. Note that FIG. 5B illustrates the clock signal (GCK) for the scan line driver circuit, signals (SR311out) output from the n output terminals of the shift register 311, signals (SR312out) output from the n output terminals of the shift register 312, and signals (SR313out) output from the n output terminals of the shift register 313.

In the first period (Tp), high-level potentials are sequentially shifted from the scan line 33 provided in the first row to the scan line 33 provided in the n-th row every half the cycle of the clock signal (horizontal scan period) in the shift register 311; high-level potentials are sequentially shifted from the scan line 33 provided in the (n+1)-th row to the scan line 33 provided in the 2n-th row every half the cycle of the clock signal (horizontal scan period) in the shift register 312; and high-level potentials are sequentially shifted from the scan line 33 provided in the (2n+1)-th row to the scan line 33 provided in the 3n-th row every half the cycle of the clock signal (horizontal scan period) in the shift register 313. Therefore, in the scan line driver circuit 31, m pixels 351 provided in the first row to m pixels 351 provided in the n-th row are sequentially selected through the scan lines 33; m pixels 352 provided in the (n+1)-th row to m pixels 352 provided in the 2n-th row are sequentially selected; and m pixels 353 provided in the (2n+1)-th row to m pixels 353 provided in the 3n-th row are sequentially selected. In other words, in the scan line driver circuit 31, scan signals can be supplied to 3m pixels provided in different three rows every horizontal scan period.

During the second period (Tb), by stopping the input of the clock signal (GCK) for the scan line driver circuit and the start signal for the scan line driver circuit (not illustrated) to the scan line driver circuit 31, supply of the scan signal that shifts and outputs the high-level potential from the scan line driver circuit 31 in sequence is stopped. During the third period (Tn), the operation of the shift registers 311 to 313 is the same as that in the first period (Tp). In other words, in the scan line driver circuit 31, as during the first period (Tp), scan signals can be supplied to 3m pixels provided in given three rows every horizontal scan period. Note that during the second period (Tb), the input of the clock signal (GCK) for the scan line driver circuit to the scan line driver circuit 31 is not necessarily stopped.

Configuration Example of Data Line Driver Circuit 32

Figure 6A:
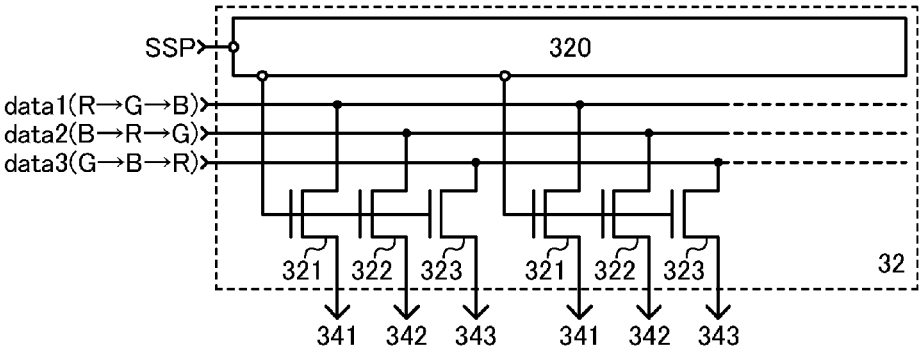
FIGS. 6A and 6B are diagrams to describe Embodiment 2.

FIG. 6A illustrates a configuration example of the data line driver circuit 32 included in the liquid crystal display device illustrated in FIG. 4A. The data line driver circuit 32 illustrated in FIG. 6A includes a shift register 320 having m output terminals, m transistors 321, m transistors 322, and m transistors 323. Note that a gate terminal of the transistor 321 is connected to a j-th output terminal (j is a natural number that is 1 or larger and m or lower) of the shift register 320; one terminal of a source and a drain of the transistor 321 is connected to wiring for supplying the first image signal (data1); and the other terminal of the source and the drain of the transistor 321 is connected to the first data line 341 provided in a j-th column in the pixel area 30. In addition, a gate terminal of the transistor 322 is connected to the j-th output terminal (j is a natural number that is 1 or larger and m or lower) of the shift register 320; one terminal of a source and a drain of the transistor 322 is connected to wiring for supplying the second image signal (data2); and the other terminal of the source and the drain of the transistor 322 is connected to the second data line 342 provided in the j-th column in the pixel area 30. Further, a gate terminal of the transistor 323 is connected to the j-th output terminal (j is a natural number that is 1 or larger and m or lower) of the shift register 320; one terminal of a source and a drain of the transistor 323 is connected to wiring for supplying the third image signal (data3); and the other terminal of the source and the drain of the transistor 323 is connected to the third data line 343 provided in the j-th column in the pixel area 30.

Note that here, the first data line 341 is supplied with, as the first image signal (data1), a red (R) image signal (an image signal held in a pixel when a backlight emits red (R) light), then a green (G) image signal, followed by a blue (B) image signal. In addition, the second data line 342 is supplied with, as the second image signal (data2), the blue (B) image signal, then the red (R) image signal, followed by the green (G) image signal. Further, the third data line 343 receives, as the third image signal (data3), the green (G) image signal, then the blue (B) image signal, followed by the red (R) image signal. Note that the first to third image signals (data1, data2, and data3) input to lines at the same time have different colors of data. Alternatively, the first to third image signals (data1, data2, and data3) may produce the same colors of data in the same order.

Configuration Example of Backlight

Figure 6B:
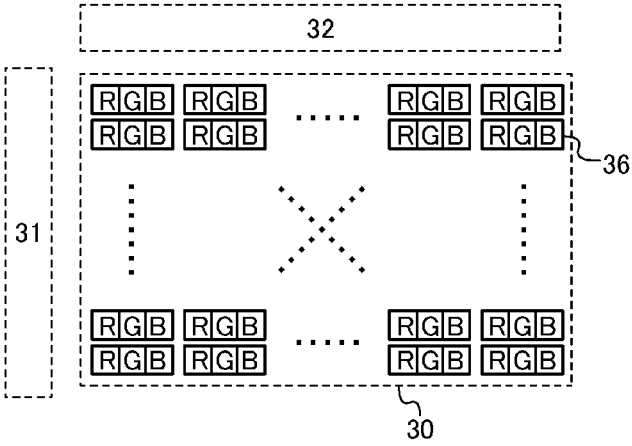

FIG. 6B illustrates a configuration example of a backlight provided behind the pixel area 30 in the liquid crystal display device illustrated in FIG. 4A. The backlight illustrated in FIG. 6B includes a plurality of backlight units 36 each including light sources of three colors of red (R), green (G), and blue (B). Note that the plurality of backlight units 36 is arranged in a matrix and lighting of the backlight units 36 can be controlled separately for particular regions. For the backlight for the plurality of pixels arranged in a matrix with 3 sets of n rows and m columns, a backlight unit 36 is dedicated to at least a matrix with k rows and m columns (here, k is n/4) here, so that lighting of the backlight units 36 can be controlled independently. In other words, the backlight can include at least a backlight unit group dedicated to the first to k-th rows to a backlight unit group dedicated to a (2n+3k+1)-th row to the 3n-th row, so that lighting of the backlight unit groups can be controlled independently.

Operation Example of Liquid Crystal Display Device

Figure 7:
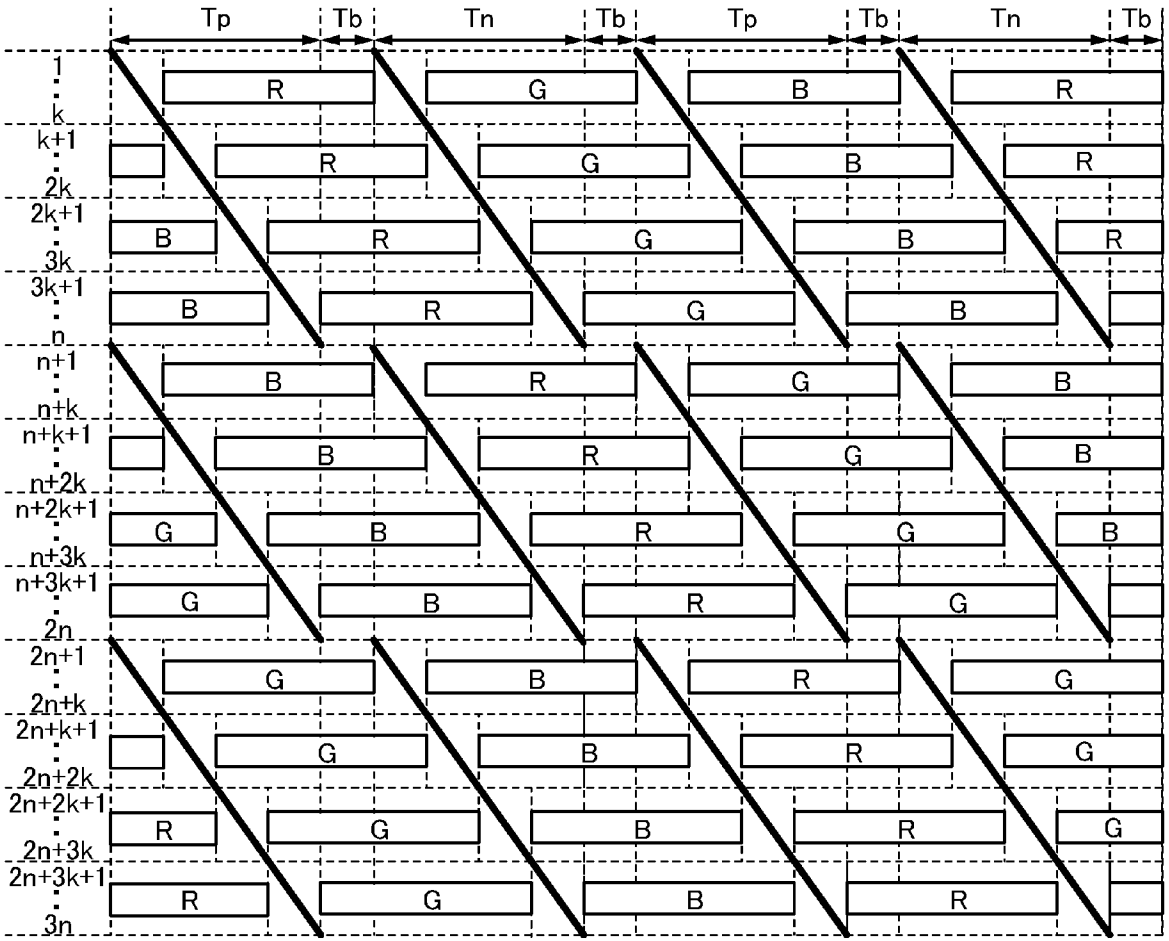
FIG. 7 is a diagram to describe Embodiment 2.

FIG. 7 is a diagram showing supply of scan signals in the above-mentioned liquid crystal display device and lighting timing for a backlight. In the liquid crystal display device, during the first period (Tp), the first to n-th rows each including the m pixels 351 are sequentially selected; the (n+1)-th to 2n-th rows each including the m pixels 352 are sequentially selected; and the (2n+1)-th to 3n-th rows each including the m pixels 353 are sequentially selected. Thus, the first image signal can be input to each pixel. During the following second period (Tb), the scan lines dedicated to the first to 3n-th rows are deselected while the lighting states of the backlights that have been lit during the first period (Tp) are maintained, and the second image signals to be supplied to the pixels in the first, (n+1)-th, and (2n+1)-th rows during the third period (Tn) are supplied to the first to third data lines. During the subsequent third period (Tn), the second image signal having the opposite polarity to that during the first period (Tp) is input to each pixel.

As for scan of a scan signal in the liquid crystal display device illustrated in FIG. 7 and lighting timing for a backlight, supply of a scan signal and lighting of a backlight unit exhibiting a given color (red (R), green (G), or blue (B)) can be concurrently performed in each region (the first to n-th rows, the (n+1)-th to 2n-th rows, and the (2n+1)-th to 3n-th rows).

Liquid Crystal Display Device in this Embodiment

The liquid crystal display device in this embodiment can prevent insufficient change in the voltages of the second image signals to be supplied to the pixels in the first, (n+1)-th, and (2n+1)-th rows during the third period by utilizing the driving method in Embodiment 1. The driving method in this embodiment, in particular, is effective in preventing insufficient change in the voltages of the second and third data lines connected to the pixels in the (n+1)-th and (2n+1)-th rows placed near the center of the pixel area and thus can reduce display defects seen by the viewer.

This embodiment can be implemented in appropriate combination with any of the structures described in the other embodiments.

Embodiment 3

In this embodiment, an example of a plan view and a cross-sectional view of a pixel included in a display device, here, a liquid crystal display device will be described with reference to drawings.

Figure 8A:
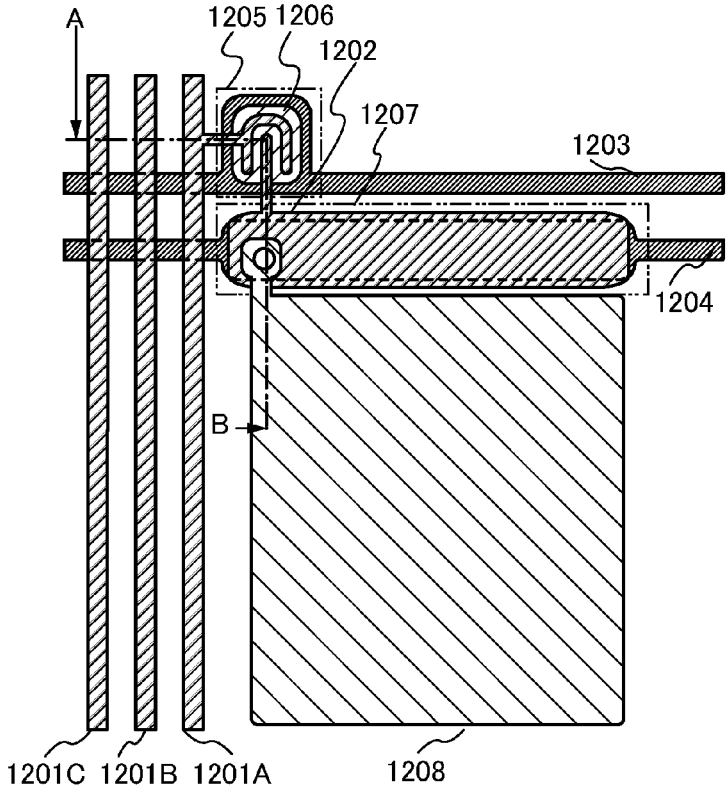
FIGS. 8A and 8B are diagrams to describe Embodiment 3.
Figure 8B:
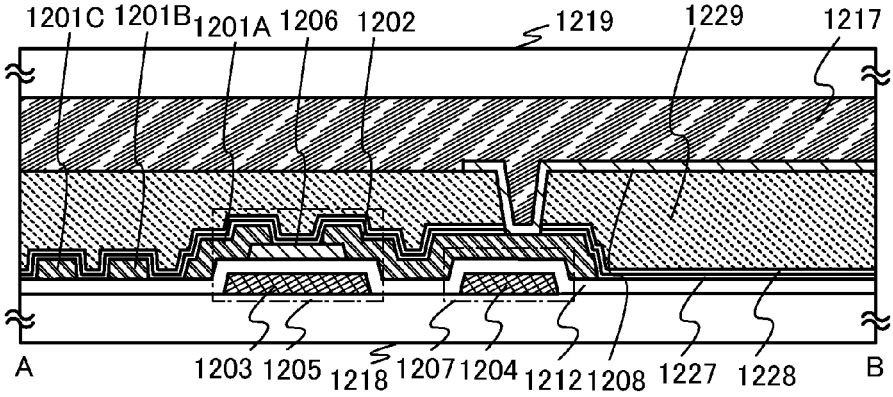

FIG. 8A is a plane view of one of a plurality of pixels included in a display panel. FIG. 8B is a cross-sectional view taken along the alternate long and short dashed line A-B in FIG. 8A.

In FIG. 8A, wiring layers (including source electrode layers 1201A to 1201C and a drain electrode layer 1202) to be the first to third data lines are extended in the vertical direction (in the column direction) in the drawing. Wiring layers (including a gate electrode layer 1203) to be scan lines are extended in the direction approximately orthogonal to the source electrode layers 1201A to 1201C (in the horizontal direction (in the row direction) in the drawing). A capacitor wiring layer 1204 is extended in the direction approximately parallel to the gate electrode layer 1203 and in the direction approximately orthogonal to the source electrode layers 1201A to 1201C (in the horizontal direction (in the row direction) in the drawing).

In FIG. 8A, a transistor 1205 including a gate electrode layer 1203 is formed in a pixel of the display panel. An insulating film 1227, an insulating film 1228, and an interlayer film 1229 are formed over the transistor 1205.

The pixel of the display panel illustrated in FIGS. 8A and 8B includes a transparent electrode layer 1208 as a first electrode layer connected to the transistor 1205. An opening (a contact hole) is formed in the insulating film 1227, the insulating film 1228, and the interlayer film 1229 which are formed over the transistor 1205. The transparent electrode layer 1208 is connected to the transistor 1205 through the opening (contact hole).

The transistor 1205 illustrated in FIGS. 8A and 8B includes a semiconductor layer 1206 formed over the gate electrode layer 1203 with the gate insulating layer 1212 interposed therebetween; and a source electrode layer 1201A and a drain electrode layer 1202 which are in contact with the semiconductor layer 1206. A stack of the capacitor wiring layer 1204, the gate insulating layer 1212, and the drain electrode layer 1202 forms a capacitor 1207.

Further, a first substrate 1218 included in the transistor 1205 overlaps with a second substrate 1219 with a liquid crystal layer 1217 interposed therebetween.

Note that although an example of the case where a bottom-gate inverted staggered transistor is used as the transistor 1205 is illustrated in FIG. 8B, there is no particular limitation on the structure of a transistor applicable to the liquid crystal display device disclosed in this specification. For example, a top-gate transistor in which a gate electrode layer is placed on the upper side of a semiconductor layer with a gate insulating layer interposed therebetween; or a bottom-gate staggered transistor or planar transistor in which a gate electrode layer is placed on the lower side of a semiconductor layer with a gate insulating layer interposed therebetween can be used.

This embodiment can be implemented in appropriate combination with any of the structures described in the other embodiments.

Embodiment 4

A display device disclosed in this specification can be applied to a variety of electronic devices (including a game machine). Examples of electronic devices include a television set (also referred to as a television or a television receiver), a screen of a computer or the like, a camera such as a digital camera or a digital video camera, a digital photo frame, a cellular phone (also referred to as a mobile phone or a cellular phone device), a portable game machine, a personal information terminal, an audio reproducing device, and a large-sized game machine such as a pachinko machine. Examples of electronic devices including the display device described in any of the above embodiments will be described.

Figure 9A:
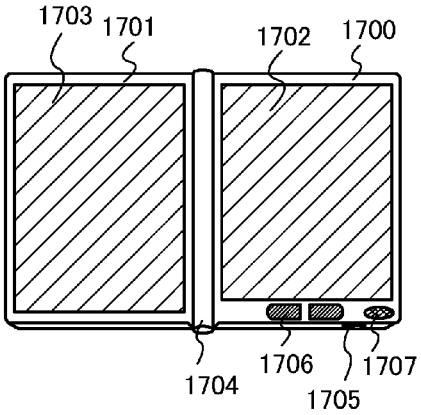
FIGS. 9A to 9D are diagrams to describe Embodiment 4.

FIG. 9A illustrates an example of an electronic book device. The electronic book device illustrated in FIG. 9A includes two housings 1700 and 1701. The housings 1700 and 1701 are combined with a hinge 1704 so that the electronic book device can be opened and closed. With such a structure, the electronic book device can be operated like a paper book.

A display portion 1702 and a display portion 1703 are incorporated in the housing 1700 and the housing 1701, respectively. The display portion 1702 and the display portion 1703 may display one image or different images. In the case where the display portions 1702 and 1703 display different images, a display portion on the right side (the display portion 1702 in FIG. 9A) can display text and a display portion on the left side (the display portion 1703 in FIG. 9A) can display images, for example.

FIG. 9A illustrates an example of the case where the housing 1700 is provided with an operation portion and the like. For example, the housing 1700 is provided with a power input terminal 1705, operation keys 1706, a speaker 1707, and the like. It is possible to turn the pages with the operation keys 1706. Note that a keyboard, a pointing device, or the like may be provided on the surface of the housing, on which the display portion is provided. Further, an external connection terminal (an earphone terminal, a USB terminal, a terminal that can be connected to various cables such as a USB cable, or the like), a recording medium insertion portion, or the like may be provided on the back surface or the side surface of the housing. Furthermore, the electronic book device illustrated in FIG. 9A may have a function of an electronic dictionary.

Figure 9B:
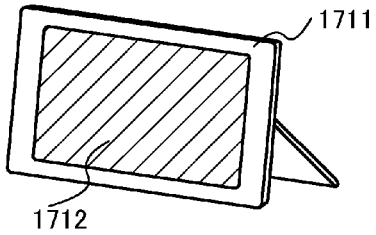

FIG. 9B illustrates an example of a digital photo frame including a display device. For example, in the digital photo frame illustrated in FIG. 9B, a display portion 1712 is incorporated in a housing 1711. The display portion 1712 can display various images. For example, the display portion 1712 can display data of an image taken with a digital camera or the like and thus function as a normal photo frame.

Note that the digital photo frame illustrated in FIG. 9B is provided with an operation portion, an external connection terminal (a USB terminal, a terminal that can be connected to various cables such as a USB cable, or the like), a recording medium insertion portion, and the like. Although these components may be provided on the surface on which the display portion is provided, it is preferable to provide them on the side surface or the back surface for the design of the digital photo frame. For example, a memory storing data of an image taken with a digital camera is inserted in the recording medium insertion portion of the digital photo frame, so that the image data can be transferred and then displayed on the display portion 1712.

Figure 9C:
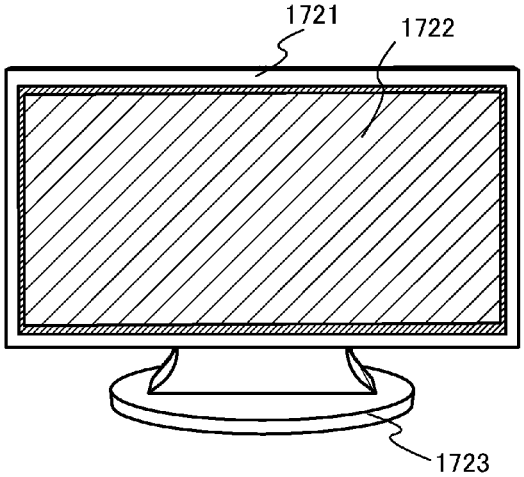

FIG. 9C illustrates an example of a television set including a display device. In the television set illustrated in FIG. 9C, a display portion 1722 is incorporated in a housing 1721. The display portion 1722 can display an image. Further, the housing 1721 is supported by a stand 1723 here. The display device described in any of the above embodiments can be applied to the display portion 1722.

The television set illustrated in FIG. 9C can be operated with an operation switch of the housing 1721 or a separate remote controller. Channels and volume can be controlled with an operation key of the remote controller so that an image displayed on the display portion 1722 can be controlled. Further, the remote controller may be provided with a display portion for displaying data output from the remote controller.

Figure 9D:
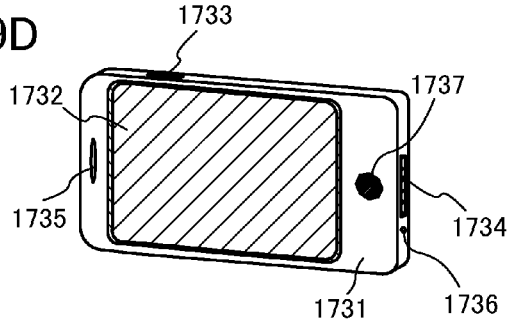
Figure 10A:
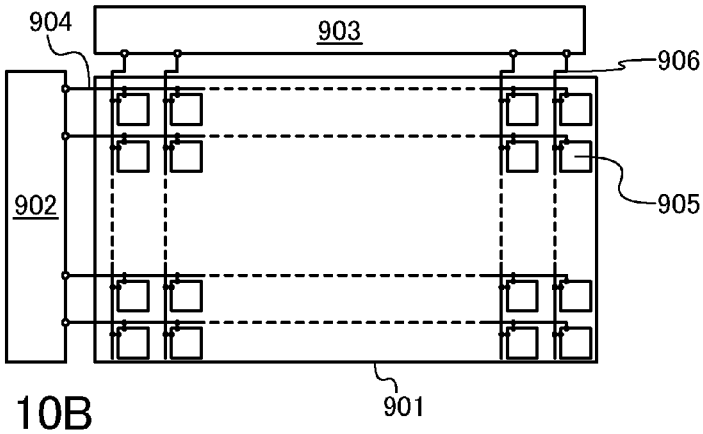
FIGS. 10A to 10E are diagrams to describe an object of one embodiment of the present invention.
Figure 10B:
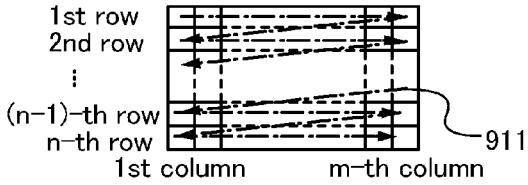
Figure 10C:
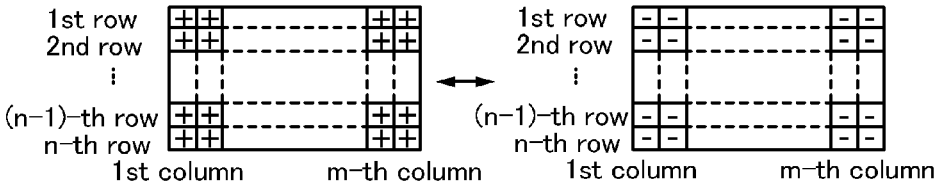
Figure 10D:
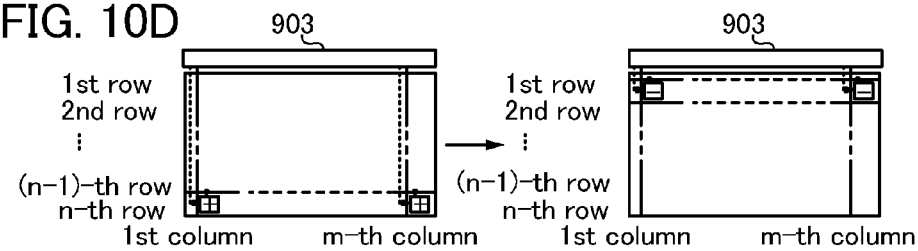
Figure 10E:
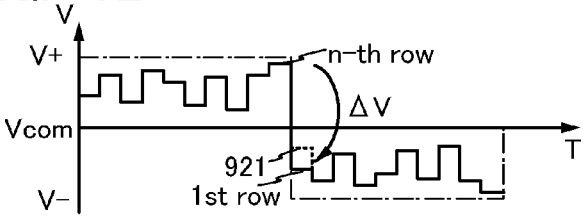
Figure 11A:
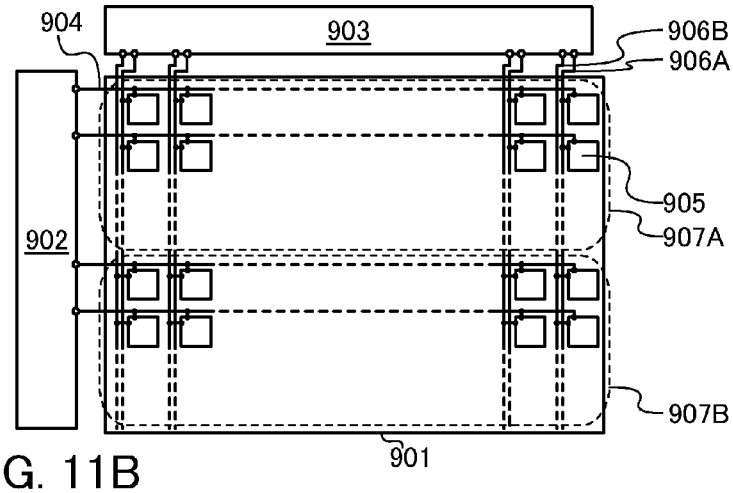
FIGS. 11A to 11D are diagrams to describe an object of one embodiment of the present invention.
Figure 11B:
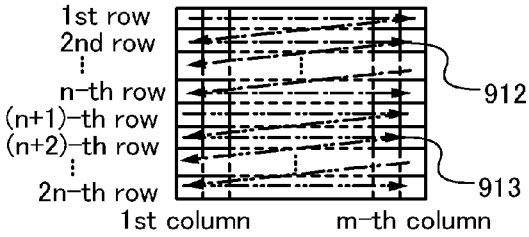
Figure 11C:
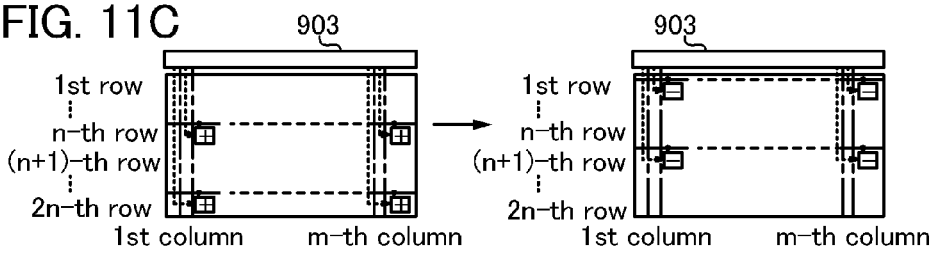
Figure 11D:
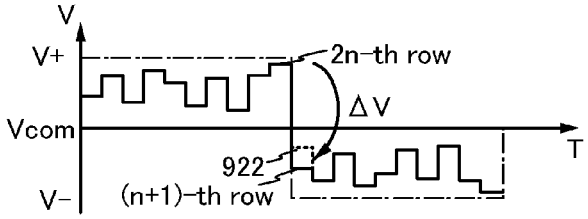

FIG. 9D illustrates an example of a cellular phone including a display device. The cellular phone illustrated in FIG. 9D is provided with a display portion 1732 incorporated in a housing 1731, an operation button 1733, an operation button 1737, an external connection port 1734, a speaker 1735, a microphone 1736, and the like.

The display portion 1732 of the cellular phone illustrated in FIG. 9D is a touch panel. When the display portion 1732 is touched with a finger or the like, contents displayed on the display portion 1732 can be controlled. Further, operations such as making calls and texting can be performed by touching the display portion 1732 with a finger or the like.

This embodiment can be implemented in appropriate combination with any of the structures described in the other embodiments.

This application is based on Japanese Patent Application serial no. 2010-194546 filed with Japan Patent Office on Aug. 31, 2010, the entire contents of which are hereby incorporated by reference.

What is claimed is:

1. A method for driving a liquid crystal display device, comprising the steps of:

supplying first image signals to pixels in first to n-th rows through first data lines sequentially and supplying second image signals to pixels in (n+1)-th to 2n-th rows through second data lines sequentially during a first period;

supplying a part of third image signals corresponding to the pixels in the first row to the first data lines and supplying a part of fourth image signals corresponding to the pixels in the (n+1)-th row to the second data lines while deselecting the pixels in the first to 2n-th rows during a second period;

supplying the third image signals to the pixels in the first to n-th rows through the first data lines sequentially and supplying the fourth image signals to the pixels in the (n+1)-th to 2n-th rows through the second data lines sequentially during a third period;

lighting first light sources with a first color in a backlight during the step of supplying the first image signals; and lighting second light sources with a second color in the backlight during the step of supplying the second image signals, wherein the supplying the first image signals and the supplying the second image signals during the first period are performed concurrently, wherein the supplying the third image signals and the supplying the fourth image signals during the third period are performed concurrently, wherein the first image signals and the second image signals are positive voltages, wherein the third image signals and the fourth image signals are negative voltages, wherein the second period is between the first period and the third period, wherein the first image signals are signals corresponding to the first color, wherein the second image signals are signals corresponding to the second color, wherein n is a natural number of 2 or more, and wherein each of the first data lines and each of the second data lines correspond to one column of pixels.

2. The method for driving the liquid crystal display device according to claim 1, wherein each of the first light sources and the second light sources in the backlight is one of red light sources, green light sources, and blue light sources.

3. The method for driving the liquid crystal display device according to claim 1, wherein the part of the third image signals corresponding to the pixels in the first row and the part of the fourth image signals corresponding to the pixels in the (n+1)-th row are supplied more than once while deselecting the pixels in the first to 2n-th rows during the second period.

4. The method for driving the liquid crystal display device according to claim 1, wherein the part of the third image signals corresponding to the pixels in the first row are supplied from a data line driver circuit during the second period and during the third period, and wherein the part of the fourth image signals corresponding to the pixels in the (n+1)-th row are supplied from the data line driver circuit during the second period and during the third period.

5. A method for driving a liquid crystal display device, comprising the steps of:

supplying first image signals to pixels in first to n-th rows through first data lines sequentially, supplying second image signals to pixels in (n+1)-th to 2n-th rows through second data lines, and supplying third image signals to pixels in (2n+1)-th to 3n-th rows through third data lines during a first period;

supplying a part of fourth image signals corresponding to the pixels in the first row to the first data lines, supplying a part of fifth image signals corresponding to the pixels in the (n+1)-th row to the second data lines, and supplying a part of sixth image signals corresponding to the pixels in the (2n+1)-th row to the third data lines while deselecting the pixels in the first to 3n-th rows during a second period;

supplying the fourth image signals to the pixels in the first to n-th rows through the first data lines sequentially, supplying the fifth image signals to the pixels in the (n+1)-th to 2n-th rows through the second data lines, and supplying the sixth image signals to the pixels in the (2n+1)-th to 3n-th rows through the third data lines during a third period;

lighting first light sources with a first color in a backlight during the step of supplying the first image signals;

lighting second light sources with a second color in the backlight during the step of supplying the second image signals;

lighting third light sources with a third color in the backlight during the step of supplying the third image signals, wherein the supplying the first image signals, the supplying the second image signals, and the supplying the third image signals during the first period are performed concurrently, wherein the supplying the fourth image signals, the supplying the fifth image signals, and the supplying the sixth image signals during the third period are performed concurrently, wherein the first image signals, the second image signals and the third image signals are positive voltages, wherein the fourth image signals, the fifth image signals, and the sixth image signals are negative voltages, wherein the second period is between the first period and the third period, wherein the first image signals are signals corresponding to the first color, wherein the first image signals are signals corresponding to the first color, wherein the second image signals are signals corresponding to the second color, wherein the third image signals are signals corresponding to the third color, wherein n is a natural number of 2 or more, and wherein each of the first data lines, each of the second data lines, and each of the third data lines correspond to one column of pixels.

6. The method for driving the liquid crystal display device according to claim 5, wherein each of the first light sources, the second light sources, and the third light sources in the backlight is one of red light sources, green light sources, and blue light sources.

7. The method for driving the liquid crystal display device according to claim 5, wherein the part of the fourth image signals corresponding to the pixels in the first row, the part of the fifth image signals corresponding to the pixels in the (n+1)-th row, and the part of the sixth image signals corresponding to the pixels in the (2n+1)-th row are supplied more than once while deselecting the pixels in the first to 3n-th rows during the second period.

8. The method for driving the liquid crystal display device according to claim 5, wherein the part of the fourth image signals corresponding to the pixels in the first row are supplied from a data line driver circuit during the second period and during the third period, wherein the part of the fifth image signals corresponding to the pixels in the (n+1)-th row are supplied from the data line driver circuit during the second period and during the third period, and wherein the part of the sixth image signals corresponding to the pixels in the (2n+1)-th row are supplied from the data line driver circuit during the second period and during the third period.

9. The method for driving the liquid crystal display device according to claim 1, wherein the step of lighting first light sources with the first color in the backlight and the step of lighting second light sources with the second color in the backlight are performed concurrently.

10. The method for driving the liquid crystal display device according to claim 8, wherein each of the first light sources and the second light sources in the backlight is one of red light sources, green light sources, and blue light sources.

11. The method for driving the liquid crystal display device according to claim 9, wherein the part of the third image signals corresponding to the pixels in the first row and the part of the fourth image signals corresponding to the pixels in the (n+1)-th row are supplied more than once while deselecting the pixels in the first to 2n-th rows during the second period.

12. The method for driving the liquid crystal display device according to claim 9, wherein the part of the third image signals corresponding to the pixels in the first row are supplied from a data line driver circuit during the second period and during the third period, and wherein the part of the fourth image signals corresponding to the pixels in the (n+1)-th row are supplied from the data line driver circuit during the second period and during the third period.

13. The method for driving the liquid crystal display device according to claim 5, wherein the step of lighting the first light sources with the first color in the backlight, the step of lighting the second light sources with the second color in the backlight, and the step of lighting the third light sources with the third color in the backlight are performed concurrently.

14. The method for driving the liquid crystal display device according to claim 13, wherein each of the first light sources and the second light sources in the backlight is one of red light sources, green light sources, and blue light sources.

15. The method for driving the liquid crystal display device according to claim 13, wherein the part of the fourth image signals corresponding to the pixels in the first row, the part of the fifth image signals corresponding to the pixels in the (n+1)-th row, and the part of the sixth image signals corresponding to the pixels in the (2n+1)-th row are supplied more than once while deselecting the pixels in the first to 3n-th rows during the second period.

16. The method for driving the liquid crystal display device according to claim 13, wherein the part of the fourth image signals corresponding to the pixels in the first row are supplied from a data line driver circuit during the second period and during the third period, wherein the part of the fifth image signals corresponding to the pixels in the (n+1)-th row are supplied from the data line driver circuit during the second period and during the third period, and wherein the part of the sixth image signals corresponding to the pixels in the (2n+1)-th row are supplied from the data line driver circuit during the second period and during the third period.

* * * * *

UNITED STATES PATENT AND TRADEMARK OFFICE

CERTIFICATE OF CORRECTION

PATENT NO. : 8,643,580 B2
APPLICATION NO. : 13/213511
DATED : February 4, 2014
INVENTOR(S) : Yoshiyuki Kurokawa et al.

It is certified that error appears in the above-identified patent and that said Letters Patent is hereby corrected as shown below:

In the Specification

At column 4, line 30, “column” should be --column.--;

In the Claims

In claim 5, at column 21, lines 40-41, delete “wherein the first image signals are signals corresponding to the first color;”;

In claim 10, at column 22, line 19, “8,” should be --9,--.

Signed and Sealed this
Eleventh Day of November, 2014

Michelle K. Lee

Michelle K. Lee
*Deputy Director of the United States Patent and Trademark Office*